US011111044B2

(12) United States Patent
Felch et al.

(10) Patent No.: US 11,111,044 B2
(45) Date of Patent: Sep. 7, 2021

(54) METHOD OF DETERMINING THE VOLUME FLOW AND THE FILLING DEGREE AT A PACKAGING MACHINE

(71) Applicant: Multivac Sepp Haggenmüller SE & Co. KG, Wolfertschwenden (DE)

(72) Inventors: Florian Felch, Durach (DE); Michael Rädler, Kempten (DE)

(73) Assignee: MULTIVAC SEPP HAGGENMUELLER SE & CO. KG, Wolfertschwenden (DE)

( * ) Notice: Subject to any disclaimer, the term of this patent is extended or adjusted under 35 U.S.C. 154(b) by 180 days.

(21) Appl. No.: 16/441,585

(22) Filed: Jun. 14, 2019

(65) Prior Publication Data

US 2019/0382142 A1 Dec. 19, 2019

(30) Foreign Application Priority Data

Jun. 14, 2018 (DE) ..... 10 2018 114 259.5

(51) Int. Cl.
*B65B 57/00* (2006.01)
*B65B 31/02* (2006.01)
*B65B 9/04* (2006.01)

(52) U.S. Cl.
CPC ..... *B65B 57/00* (2013.01); *B65B 31/028* (2013.01); *B65B 9/04* (2013.01); *B65B 31/021* (2013.01)

(58) Field of Classification Search
CPC ..... B65B 9/04; B65B 31/021; B65B 31/028; B65B 57/00
USPC ..... 53/75, 433, 511
See application file for complete search history.

(56) References Cited

U.S. PATENT DOCUMENTS 3,509,686 A * 5/1970 Bergstrom ..... B65B 31/021 53/511
4,567,713 A * 2/1986 Natterer ..... B65B 31/021 53/433
7,950,207 B2 * 5/2011 Maisel ..... B65B 31/028 53/510

(Continued)

FOREIGN PATENT DOCUMENTS

DE 1939216 A1 2/1971
DE 102004044077 A1 11/2005

(Continued)

OTHER PUBLICATIONS

European Communication dated Nov. 27, 2020 (with English Machine Translation), Application No. 19 178 020.4-1016, Applicant MULTIVAC Sepp Haggenmueller SE & Co. KG, 8 Pages.

*Primary Examiner* — Stephen F. Gerrity
(74) *Attorney, Agent, or Firm* — Brooks Kushman P.C.

(57) ABSTRACT

A method of operating a sealing station of a packaging machine for producing, in the case of possibly varying filling degrees, packages with at least substantially similar package appearances, the method comprising the execution of a comparison between a detected pressure curve and a reference pressure curve, and the calculation of a filling degree of the package positioned within the sealing station on the basis of the comparison between the detected pressure curve and the reference pressure curve, and/or the calculation of a volume flow with respect to the pressure curve or the reference pressure curve, and the setting of at least one process parameter at the packaging machine with due regard to the calculated filling degree and/or the volume flow.

19 Claims, 4 Drawing Sheets

(56) References Cited

U.S. PATENT DOCUMENTS

| | | | | |
|---|---|---|---|---|
| 8,091,322 | B2 * | 1/2012 | Ehrmann et al. | B65B 57/00 53/433 |
| 2006/0016155 | A1 * | 1/2006 | Oesterlein | B65B 31/02 53/432 |
| 2014/0020338 | A1 * | 1/2014 | Hubneret al. | B65B 57/00 53/453 |
| 2018/0222619 | A1 * | 8/2018 | Ehrmann et al. | B65B 57/00 |
| 2018/0273225 | A1 * | 9/2018 | Ehrmann et al. | B65B 57/00 |
| 2018/0297730 | A1 * | 10/2018 | Ehrmann et al. | B65B 57/00 |
| 2019/0100340 | A1 * | 4/2019 | Enderle et al. | B65B 57/00 |

FOREIGN PATENT DOCUMENTS

| | | | |
|---|---|---|---|
| DE | 102007031527 | B3 | 6/2008 |
| EP | 1935787 | A1 | 6/2008 |
| EP | 2668102 | B1 | 1/2015 |
| WO | 2017021558 | A1 | 2/2017 |
| WO | 2017125485 | A2 | 7/2017 |

* cited by examiner

METHOD OF DETERMINING THE VOLUME FLOW AND THE FILLING DEGREE AT A PACKAGING MACHINE

CROSS-REFERENCE TO RELATED APPLICATIONS

This Application claims priority to German Patent Application No. 10 2018 114 259.5 filed on Jun. 14, 2018 to Florian Felch and Michael Rädler, currently pending, the entire disclosure of which is incorporated herein by reference.

FIELD OF THE INVENTION

The present invention relates to a method of producing packages with at least substantially similar package appearances and a packaging machine for producing packages with at least substantially similar package appearances.

BACKGROUND OF THE INVENTION

EP 2 668 102 B1 discloses a packaging machine and a process for producing individually evacuated and/or gas-flushed packages. Quite generally, it is additionally disclosed that means can be used with the aid of which the filling level of the material to be packed can be determined in the respective packaging trough and/or the filling quantity of the material to be packed can be determined in the respective packaging trough. Depending on this measurement signal, for example, a shut-off member can then be controlled, so as to individually control the gas volume removed from or supplied to the respective packaging trough.

Further, FIG. 1 shows, in a schematic representation, a sealing station S' as known in the art. The sealing station S' comprises a sealing tool upper part SO' and a sealing tool lower part SU', which can be moved into contact with each other using a stroke movement H' so as to form a hermetically sealed sealing chamber SK'. For a gas flushing and/or evacuating process, a top film O' and a bottom film U' are combined within the sealing chamber SK' such that they enclose between them a package volume P' consisting essentially of the sum of a partial volume V1', which is defined by the respective packing troughs VM' formed in the bottom film U' minus the product contents I' provided, and a partial volume V2' existing above the respective packing troughs VM' and enclosed by the top film O'.

The package volume P' in its entirety is larger than the entirety of the respective individual volumes enclosed by the packages produced, so that, in particular during gas flushing/gassing, a distribution of gas can take place between the packages. Due to the positioning of a sealing tool SW' shown in FIG. 1, where the sealing tool SW' is supported in the sealing tool upper part SO' and set back thereinto, a gap SP' between the bottom film U' and the top film O' is thus formed above the packing troughs VM' positioned within the sealing station S', and the gas supplied can spread via this gap into all the packages positioned within the sealing station S'.

However, during final compacting of the package volume P', in other words, when the top film O' is pressed downwards for the sealing process, packages with a varying package appearance may be produced in spite of an optimized gas flushing process, in which for example, an adjustable multiport throttle is used, because it frequently happens that packages having different top film curvatures are produced, for example, packages that appear to be inflated or caved in.

These visual deviations are caused in the sealing process by the stroke movement (lowering) of the sealing tool SW'. Since the sealing tool SW' is first positioned at a setback position in the sealing tool upper part SO' during the gas flushing process, so as to create the gap SP' required for distributing the gas, the sealing tool SW' is subsequently displaced downwards in the direction of the packing trough VM' positioned therebelow for the sealing process, whereby it will displace the initially created partial volume V2'. By moving down the sealing tool SW', the gas-flushed partial volume V2' is forced into the partial volume V1', so to speak as an additional volume. As a result, the pressure in the package will increase. Depending on varying package contents I', packages with varying package appearances will thus be created.

The smaller the freely available partial volume V1' is, the greater the influence of the partial volume V2', which is displaced by the sealing stroke, on the pressure change within finished packages will here be.

So far, attempts have been made to counteract the above described problems by a preset gas flushing offset pressure, in other words, gas flushing was carried out at the beginning only until a pressure reduced by the gas flushing offset pressure had been reached, hoping that the desired target pressure within the packages would then be reached by the subsequent sealing stroke.

However, the use of a gas flushing offset pressure necessitates that the filling degree of the respective packages to be closed is known. For the sake of simplicity, it has hitherto been assumed in conventional cases of use that the product line had a constant filling degree throughout the respective packages. Hence, problems arise whenever, contrary to the above-mentioned assumption, the respective packages do not have a uniform filling degree, as may be the case in particular when target-weight products with varying product densities, such as sliced meat or cheese, are involved. Due to varying filling levels, this leads, in spite of the use of a predetermined gas flushing offset pressure, to finished packages with different visual appearances.

In addition, it has hitherto been necessary to manually calculate the gas flushing offset pressure during a setting process and to enter it as a calculation parameter at the packaging machine, so that its use is often reserved for specially trained operating personnel.

It follows that working with constant, preset process parameters does not provide the desired production quality and can be optimized, in particular with respect to a production and tailored to each individual product.

Operating a packaging machine based on the assumption that the filling degree will not change throughout the respective packages and/or that a respective volume flow predetermined for gas flushing will not change, without taking into account the actually existing filling degrees of individual packages, may lead to a substantial amount of reject packages due to visual appearance.

This can be influenced by the fact that, within the product line, it frequently happens that empty packages may temporarily undergo the gas flushing and/or evacuating process due to interruptions in product supply. The empty packages carried along in these cases will then extremely falsify the gas flushing and/or evacuating process, if fixedly preset process parameters are used. As a result, the desired appearance is not accomplished, at least not in the case of the filled packages processed together with the empty packages in one work cycle.

SUMMARY OF THE INVENTION

It is the object of the present invention to provide a method and an apparatus for producing packages with at least substantially similar package appearances. The present invention is aimed to make this possible even if the respective packages have varying filling degrees, in other words, if they are filled in a non-uniform manner as regards their volume.

The present invention relates to a method of operating a sealing station of a packaging machine, in particular a thermoform packaging machine. The method is configured to produce packages with at least substantially similar package appearances in the case of possibly varying filling degrees. The method according to the present invention may comprise the following steps: filling a free package volume enclosed between a lower and an upper packaging material and defined by at least one package positioned within the sealing station with a gas, intended to be used for creating a desired atmosphere, from an initial pressure prevailing in the package volume up to a predetermined gas flushing pressure; and detecting, at least temporarily during filling of the package volume, a pressure curve using at least one pressure-detecting sensor system connected to the package volume, the pressure curve being preferably detected on the basis of a time-dependent pressure curve between the initial pressure and the predetermined gas flushing pressure.

The method may also comprise the steps of comparing the detected pressure curve with a reference pressure curve detected preferably on the basis of a pressure curve, which, in turn, is time-dependent, for filling a known free reference package volume of at least one, in particular empty reference package positioned within the sealing station with the gas between the initial pressure and the predetermined gas flushing pressure; and calculating a filling degree of the package positioned within the sealing station on the basis of the comparison between the detected pressure curve and the reference pressure curve, and/or a volume flow with respect to the pressure curve or the reference pressure curve; and setting at least one process parameter at the packaging machine with due regard to the calculated filling degree and/or volume flow.

With the aid of the observation of the current pressure curve during the gas flushing process, the present invention may determine a filling degree of a "packaging format" provided within the sealing station, in other words, of the respective packages processed per machine cycle at the sealing station in one working process, and, optionally, based thereon, in adaptation to the respective packaging format, the volume flow of the gas flushing medium.

One element of the present invention may be to detect, at least temporarily, but preferably right at the beginning of the gas flushing process, the pressure curve at a packaging format and to compare it with a reference pressure curve, which is generated and detected for example, at a packaging format of empty packages. Using an analysis, in other words, a comparison of the respective gradients of the increases in pressure, it may be possible to calculate the filling degree of the current packaging format, in other words, of the packages positioned within the sealing station, and, optionally, also an especially optimum volume flow of the gas flushing medium used therefor, so as to carry out on this basis the processing of the current packaging format and/or of at least one subsequent packaging format in a process-controlled manner.

Hence, the present invention may allow the detection and use, per machine cycle, of a current filling degree and/or a volume flow value as one or more process parameters, in particular as a basis for calculating at least one process parameter for the production process, either at the sealing station itself and/or at other working stations of the packaging machine.

In particular, the invention allows the comparison between the pressure curve and the reference pressure curve to be carried out early enough, in other words, during a predeterminable time window at the start of filling, for allowing a filling degree and/or a volume flow to be predicted (calculated) for the same packaging format, in real time so to speak, so that the process parameter may be adjusted during a residual filling time, in other words, before a variable gas flushing final pressure within the package volume is reached. In other words, the time window for the above-mentioned comparison can be timed such that the current packaging format itself can be influenced in a process-controlled manner on the basis of the comparison carried out in this respect. This kind of advantageous cascading can lead to a higher process accuracy.

The present invention may be based on easily executable method steps for better adapting the production process to possibly varying filling levels, whereby a better product quality, in other words, packages with at least substantially similar package appearances, may be produced.

The present invention is excellently suitable for high-quality packaging of respective target-weight products having varying product volumes, in particular for packaging fresh meat or cheese with varying product densities. Even in the event that, for reasons of process technology, empty packages are included in the product line during the production process, the "empty contents" of these empty packages can optimally be compensated making use of the method steps according to the present invention, so that packages having the desired package appearance can be produced even if a packaging format comprises empty packages.

For deriving the filling degree, in particular for executing the comparison between the detected pressure curve and the reference pressure curve, it may be expedient to assume an isothermal change of state under identical volume flow conditions, and preferably identical pressure conditions and possibly an identical throttle valve position. The derivation may be preferably based on the Boyle-Mariotte law as a theoretical basis. It may be particularly advantageous when, based on at least one process parameter (for example, gas flushing temperature, volume flow, pressure ratio, throttle position for gas flushing, etc.) preset at the sealing station, a corresponding reference pressure curve can be retrieved for carrying out the method according to the present invention, so that the method according to the present invention can be used in the production of various types of packages.

According to an advantageous embodiment of the present invention, a quotient resulting from a ratio of a time detected for the pressure curve and a time detected for the reference pressure curve may be subtracted from a whole for calculating the filling degree.

For detecting and/or calculating the elapsed time for the pressure curve, which occurs, during the filling process, within the packages positioned in the sealing station and which rises between various pressure levels, a detection and/or calculation unit may be preferably used, which may be optionally an integral component of a control unit of the packaging machine.

It may be of advantage in one embodiment when a variable time window for detecting the pressure curve may be selected at the packaging machine. For example, a larger time window for detecting the pressure curve could be selected for longer gas flushing processes, since the respective filling degree and/or volume flow may thus be predicted more precisely.

On the basis of a time detected and/or calculated for the reference pressure curve in advance, a time-based comparison with the reference pressure curve may be executed while gas flushing is still taking place. For this purpose, a memory of the packaging machine has preferably stored therein at least one time-dependent reference pressure curve, which has been predetermined for the package format and with respect to which the filling degree of the current packaging format can be determined. For the process-controlled comparison, in particular reference pressure curves of different package formats may be kept available, so that the invention can be used for a visually homogeneous production of various package formats. A particularly meaningful comparison can be accomplished when comparable process parameters, for example, identical volume flows, are used for establishing the reference pressure curve and the detected pressure curve.

In this context, it may especially be the case that, in one embodiment, the filling degree and/or the volume flow may be calculated in real time per machine cycle and that, on this basis, an automated adaptation of the process parameter is carried out. In real time means here that the automated adaptation of the process parameter takes place while the same working cycle is still going on and may in particular also concern an adjustment of the gas flushing process which is executed at the time in question and during which the filling degree is determined.

It may be advantageous when the process parameter is an offset pressure used during the current filling process and/or during at least one subsequent filling process, so as to fill the package volume with gas only until a pressure is reached that results from a gas flushing target pressure for finished packages minus the calculated offset pressure.

For a better production quality, the offset pressure may be adapted in an automated manner, at least at intervals, but preferably per machine cycle, so that varying filling levels can better be taken into consideration during production. In this case it may be possible to continuously adapt the filling pressure to the detected filling levels, so that the subsequent sealing stroke will precisely generate the gas flushing target pressure in the interior of the package. As a result, visually equivalent packages, in other words, packages with the same gas flushing target pressure, may leave the sealing station.

It will be expedient when, for calculating the offset pressure, the Boyle-Mariotte law is used, taking into account a partial volume defining part of the package volume and displaced by a sealing stroke and a free package volume, which can be determined in the light of the calculated filling degree, including the gas flushing target pressure of finished packages to be generated in said free package volume. When the Boyle-Mariotte law is applied, an isothermal pressure balance between the packages positioned within the sealing station can be assumed.

Preferably, the process parameter is a gas velocity reached at respective gas pins configured for filling the package volume. This may be useful, taking into account the nature of the products, in particular the nature of food products fed into the packages. It is, for example, of importance whether dimensionally stable, one-piece products with a firm surface texture, such as a piece of cheese, or products with an unstable surface texture, in particular an applied surface texture, such as breaded meat, are gas flushed. Packages with a high detected filling degree having breaded meat inserted therein could be gas flushed with reduced gas velocity to prevent damage to the breading layer. On the other hand, for an increased production rate, gas flushing with a higher gas velocity could be used as a fundamental setting in the case of one-piece package contents having a stable surface, especially if a low filling degree is detected.

According to an embodiment, the process parameter may be a valve setting value, in particular a throttle valve position, which influences an evacuating process and/or the gas flushing process. The pressure curve within the package volume may, therefore, be influenced in a targeted manner. Preferably, the valve setting value is automatically adapted continuously during the production process, so that optimum process settings can always be used. This supports in particular precise gas flushing and offers excellent control for the production of visually equivalent products.

According to an embodiment, the process parameter triggers a malfunction indicator at the packaging machine. This allows, for example, to detect leaks during the production process, in particular during the gas flushing and/or evacuating process within the sealing station, and to make such leaks immediately known to the operating personnel, so that the production may be interrupted, if necessary, for adapting for example, process parameters at the packaging machine.

Preferably, the (free) package volume is connected to a collecting volume of known size and, based on a detected pressure compensation; the (free) package volume is calculated. The collecting volume of known size may be an external storage facility, an external gas tank or a volume created by the tool upper part of the sealing station. This course of action can be used in particular for precisely calculating a reference package volume of empty packages of a packaging format, which can then be used for calculating the reference pressure curve.

A separately provided gas tank may be configured such that it can be shut off using an additional valve, so that the pressure compensation between the gas tank and the free package volume can be controlled precisely. After gas flushing of the packages to a desired pressure, a pressure change in the gas tank can be detected, which is used as a basis for calculating the volume shift, thus allowing the residual volume, in other words, the (free) package volume, to be calculated. Also in this case, the Boyle-Mariotte law may be used as a calculation basis.

According to an improved embodiment, the process parameter is continuously adjusted in the light of averaged values of the filling degree and/or of the volume flow. The control effort at the packaging machine may be reduced in this way. This may be advantageous in particular in an operating situation where small changes in the filling degree will occur with high probability, for example, in packaging processes of sliced sausages.

According to a variant, the package volume filled with gas is formed such that a pressure compensation between a plurality of packages positioned within the sealing station will take place during the gas flushing process, in particular during the sealing stroke. The respective packages enclosed within a sealing chamber may here be connected via a gap formed between the upper and the lower packaging material. The process parameter may here be an adjustable speed of a stroke movement of the sealing tool, which is displaceably supported within the sealing station, so that this sealing tool will move such that the pressure compensation between the plurality of packages provided can take place reliably.

Preferably, a supply line volume, which is connected to the package volume and which results for example, from a gas flushing line, an evacuation line and/or a tool volume, may be subtracted when the filling degree is calculated. Additionally or alternatively, it would also be possible to subtract, when the filling degree is calculated, the sealing plate stroke, in other words, the package partial volume displaced thereby, in the light of known geometries of the sealing tool upper part. Assuming that these values, which may falsify the calculation of the filling degree, remain constant, standard values, which are stored in the machine control unit, may be used for this purpose.

The principle according to the present invention could, preceding the gas flushing process, already be realized during an evacuating process. It would thus be possible in one embodiment to functionally transfer the embodiments described hereinbefore in connection with the present invention to the evacuating process, so that a process-controlled parameter setting based thereon can already take place during the evacuating process.

Preferably, one embodiment of the present invention can also be used for setting process parameters also outside the sealing station, in other words, at other working stations of the packaging machine, such that the respective working stations of the packaging machine may be able to cooperate excellently for achieving an improved production result. The present invention thus contributes to a packaging machine which is process-controlled in its entirety.

One embodiment of the present invention also relates to a packaging machine, which is especially provided in the form of a thermoform packaging machine and the sealing station of which is configured for producing, in the case of possibly varying filling degrees, packages with at least substantially similar package appearances. The packaging machine according to the present invention comprises, in addition to the sealing station, a control unit, which is functionally connected to at least one sensor system formed at the sealing station and used for detecting a pressure of a package volume provided within the sealing station.

Thus, according to one embodiment of the present invention, the control unit may be configured for calculating a filling degree on the basis of a comparison between a time-dependent pressure curve, which is detected between predetermined pressure levels at least temporarily during a filling process of the package volume enclosed within the sealing station, and a time-dependent reference pressure curve representative of the filling process of a known reference volume and stored in the control unit between the predetermined pressure levels, and/or a volume flow with respect to the pressure curve or the reference pressure curve, the control unit being further configured for setting at least one process parameter at the packaging machine with due regard to the calculated filling degree and/or the volume flow.

According to the present invention, the control unit may be configured as a process-controlled sequence control, so that an operation of the packaging machine can be adapted excellently to the respective actual measurement of the measured variables. Making use of the current pressure curve that can be detected by the sensor system and transmitted to the control unit, the control unit may determine the filling degree and/or the volume flow based on a comparison between the pressure curve and a reference pressure curve provided for the production situation. Using this as a basis, the control unit may set at least one process parameter of at least one further actor of the packaging machine. It follows that, in accordance with a control algorithm for carrying out the aforementioned comparison, process parameters (control signals), which act via actors on an object to be controlled (technological process, control path) at the packaging machine, for example on at least one working process at the sealing station, may be formed as output signals from the input signals of the control device, said input signals being representative of the pressure curve.

Other aspects and advantages of the present invention will be apparent from the following detailed description of the preferred embodiments and the accompanying drawing figures.

DESCRIPTION OF THE SEVERAL VIEWS OF THE DRAWINGS

In the following, an advantageous embodiment of the present invention will be explained in more detail making reference to a drawing, in which the individual figures show.

DETAILED DESCRIPTION OF THE INVENTION

Figure 1:
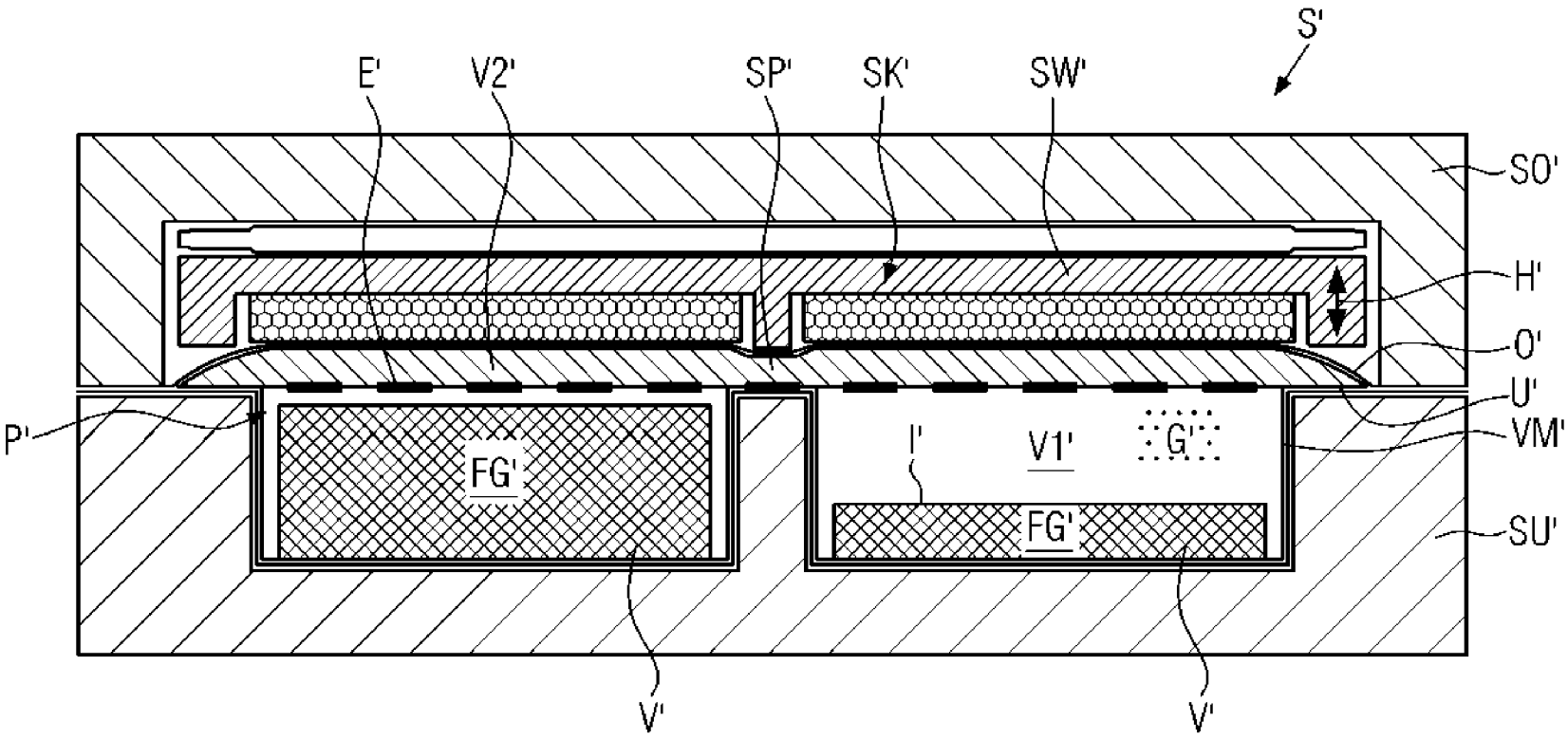
(Prior Art) FIG. 1
FIG. 1 is a schematic section view of a sealing station known in the art.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

FIG. 1 shows in a schematic representation a sealing station S' according to the prior art. The sealing station S' comprises a sealing tool upper part SO' as well as a sealing tool lower part SU', which is adapted to be closed by the sealing tool upper part SO' and configured for accommodating preshaped packaging troughs VM'. The packaging troughs VM' shown in FIG. 1 accommodate therein package contents I', in other words, products, with different filling degrees FG'.

In FIG. 1, the sealing station S' defines a sealing chamber SK', in which the packaging troughs VM' enclose, together with a top film O' positioned thereabove, an airtight package volume P' consisting of a partial volume V1' and a partial volume V2'. The partial volume V1' is composed of the sum of the respective packaging trough volumes created by the packaging troughs VM' and not occupied by the products. The partial volume V2' is an imaginary partial volume enclosed between the top film O' and an imaginary plane E' shown by a broken line. Based on the partial volume V2', a connection gap SP' is formed above the packaging troughs VM', which, in particular during the filling process, allows the gas G' to spread within the whole package volume P'.

According to FIG. 1, a sealing tool SW', for example, a vertically adjustable sealing frame, used for a sealing process is positioned within the sealing tool upper part SO', the sealing tool SW' being configured for moving, by means of a stroke movement H', the top film O' for the sealing process in the direction of the packaging troughs VM' provided therebelow.

In the embodiment shown in FIG. 1, the package volume P', which consists of the sum of the respective partial volumes V1', V2', is first filled with a gas G' up to a preset gas flushing pressure so as to create a desired atmosphere. The gas flushing pressure is traditionally generated from a difference between a gas flushing target pressure of finished packages and a preset gas offset pressure. By means of the subsequent stroke movement H', the sealing tool SW' forces the gas quantity contained in the partial volume V2' into the partial volume V1' not occupied by the product contents I' within the packaging troughs VM', so that, based on the assumption of a homogeneous filling level distribution, in other words, in the case of non-varying filling levels, the gas flushing target pressure can be established in the finished packages.

As has already been explained hereinbefore in the introduction to the specification, the respective filling degrees of the packages provided may vary so that the above offset approach, which, contrary to actual circumstances, is based on the assumption of a homogeneous filling level distribution, results in the production of packages having different appearance characteristics.

Figure 2:
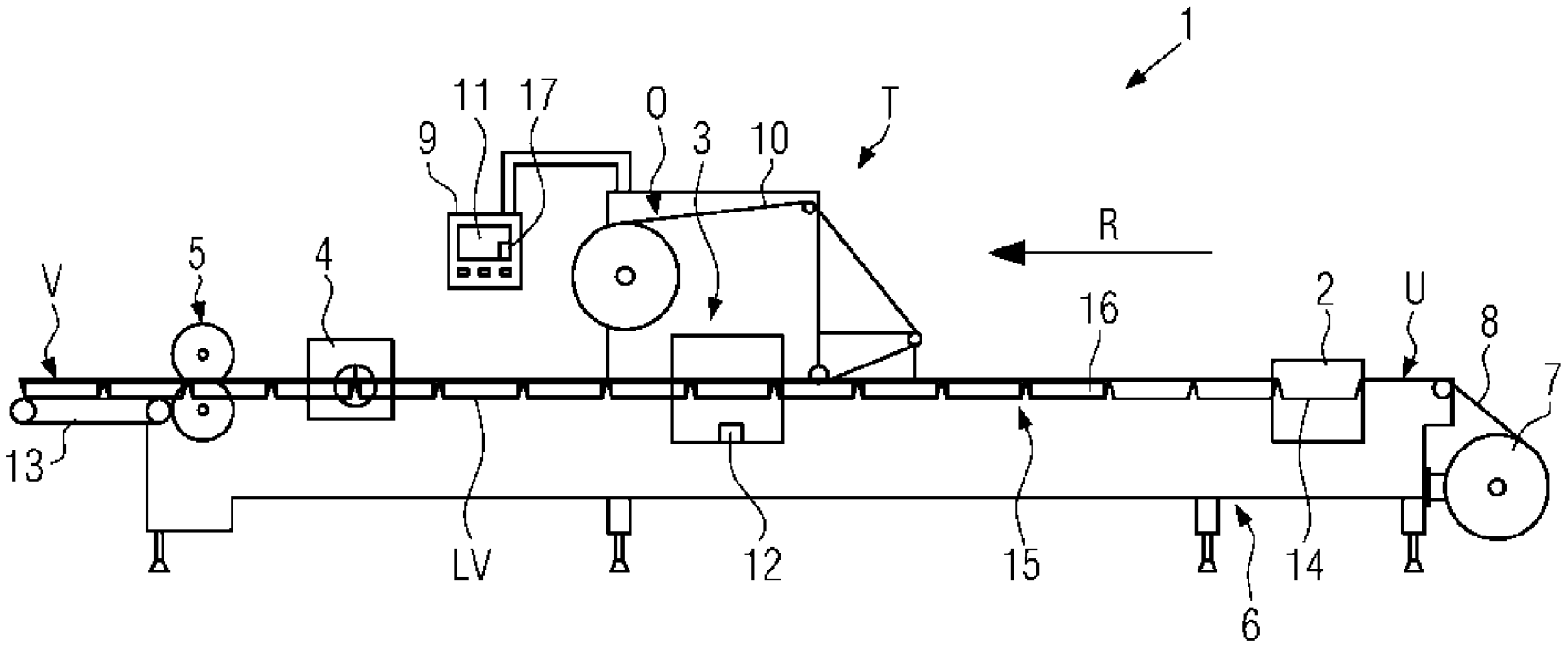
FIG. 2 is a schematic side view of one embodiment of a packaging machine in accordance with the teachings of the present disclosure and configured in the form of a thermoform packaging machine.

FIG. 2 shows, in a schematic view, a packaging machine 1 configured in the form of a thermoform packaging machine T. The packaging machine 1 comprises a forming station 2, a sealing station 3, a transverse cutting unit 4 as well as a longitudinal cutting unit 5. These components are arranged in this order in a working direction R on a machine frame 6.

The machine frame 6 of the packaging machine 1 has arranged thereon a supply roll 7 from which a bottom film U is unwound as a lower packaging material 8. The bottom film U is conveyed into the forming station 2 by a feed unit, which is not shown. Using a thermoforming process carried out there, packaging troughs 14 are formed into the bottom film U using the forming station 2. Subsequently, the packaging troughs 14 are advanced to an infeed line 15, where they can be filled with a product 16 manually or in an automated manner. Subsequent to the infeed line 15, the packaging troughs 14 filled with the products 16 are advanced to the sealing station 3. Using the sealing station 3, the packaging troughs 14 can be sealed with a top film O, which defines an upper packaging material 10, so that closed packages V will be produced by sealing the top film O onto the packaging troughs 14. The closed packages V can be separated from one another using the transverse cutting unit 4 and the longitudinal cutting unit 5 and taken away using a discharge unit 13. It may be that the articles conveyed comprise empty packages LV, for example, due to an interruption in the package providing process.

In addition, the packaging machine 1 shown in FIG. 2 is provided with an operating terminal 9, where process parameters can be set for the respective working stations provided at the packaging machine 1. The operating terminal 9 comprises a control unit 11, which is shown only schematically. The control unit 11 is configured to carry out arithmetic operations, in particular in real time during the production process, so as to control on this basis the packaging machine in a process-based manner, in other words, to cause the respective process parameters of the packaging machine to be adapted in a process-controlled manner, if necessary.

Figure 3:
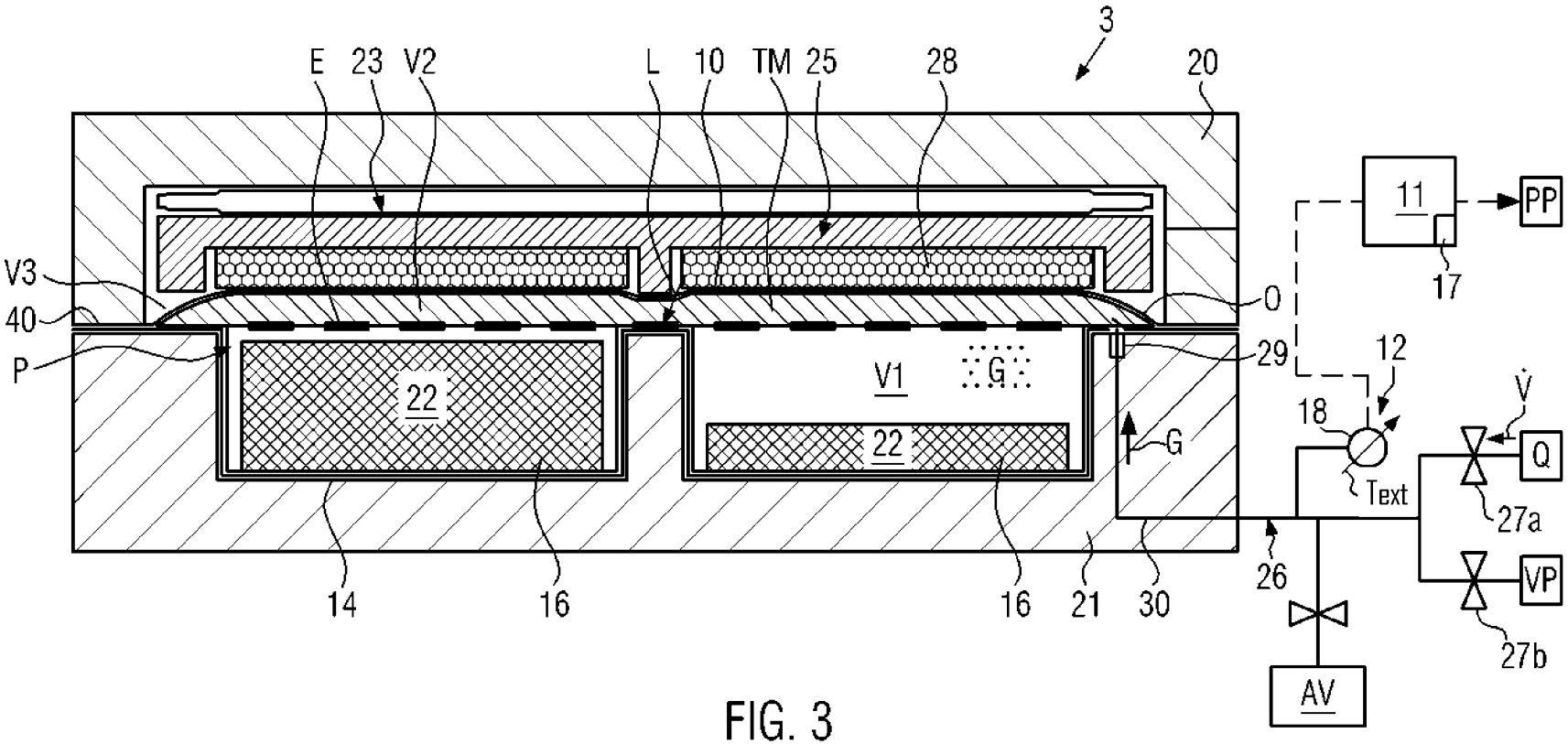
FIG. 3 is a schematic section view of one embodiment of a sealing station in accordance with the teachings of the present disclosure.

The control unit 11 is connected to a sensor system 12 for detecting a pressure $P_{IST}$ (cf. FIG. 3) of a package volume P formed within the sealing station 3 according to FIG. 3. Making use of the sensor system 12, current pressure values, in other words, respective pressure curves, can be transmitted continuously to the control unit 11 during the production process, in other words, during the gas flushing and/or evacuating process.

FIG. 2 additionally shows that the control unit 11 is connected to a schematically shown memory 17, so that, for generating process parameters, in particular for adapting the latter, the control unit 11 can resort to reference values stored in this memory 17. For example, it can compare the pressure curve detected as an input variable at the sealing station 3 using the sensor system 12 with a respective reference pressure curve of the memory 17. In so doing, it determines a filling degree and/or a volume flow using an algorithm in a first step and generates, based thereon, at least one process parameter as an output variable in a further step. On the basis of this process parameter, the production process can be adapted, so that the packaging machine 1 will be able to optimally adapt the production process taking place thereon to the respective filling states.

FIG. 3 shows, in an isolated view, the sealing station 3 of the packaging machine 1 shown in FIG. 2.

The sealing station 3 comprises a sealing tool upper part 20 as well as a sealing tool lower part 21, which enclose a sealing chamber 23. FIG. 3 additionally shows that two packaging troughs 14 with respective products 16 are accommodated in the sealing tool lower part 21, the respective filling degrees 22 of these packaging troughs 14 differing from one another.

The packaging troughs 14 accommodated within the sealing station 3 enclose, together with the top film O arranged thereabove, a package volume P. An imaginary plane E, which is shown by a broken line, extends through the package volume P, thus dividing the latter into a partial volume V1 and a partial volume V2. The packaging trough 14 having a lower filling degree 22 and located on the right, when seen in the image plane, constitutes a part of the package volume P that is larger than that of the other packaging trough 14 with a higher filling degree 22 shown on the left next to the first-mentioned packaging trough 14.

According to FIG. 3, the partial volume V2 enclosed by the top film O and the imaginary plane E as well as the partial volume V1 (free package volume P) provided within the packaging troughs 14 are adapted to be filled with a gas G via a line 26 and gas pins 29 provided thereon. For supplying gas, a gas source Q is provided. An evacuating process can be controlled using a (vacuum) pump VP. For the filling process and the evacuating process, valves 27*a*, 27*b* are formed in the line 26, these valves being controllable in particular in a process-controlled manner, for example, on the basis of detected pressure values.

The line 26 has connected thereto a pressure sensor 18 as a sensor system 12 for detecting the pressure $P_{IST}$ prevailing within the package volume P. The pressure sensor 18 is functionally connected to the control unit 11, which is configured to use the pressure $P_{IST}$, which is transmitted thereto as an input variable, for further calculations. In particular, the control unit 11 is able to determine the pressure curve resulting from the detected pressure values $P_{IST}$ during the filling of the package volume P and to compare it, optionally a section thereof, with a preset reference pressure curve so as to calculate on this basis using an algorithm a filling degree and/or a volume flow with respect to the packages V positioned within the sealing station 3, the control unit 11 generating on this basis at least one process parameter PP as an output variable.

According to FIG. 3, the line 26 has connected thereto a collecting volume AV, which can be used for calculating the package volume P. In addition, FIG. 3 shows a supply line section 30 whose volume can be subtracted when the filling degree 22 is calculated.

Figure 4:
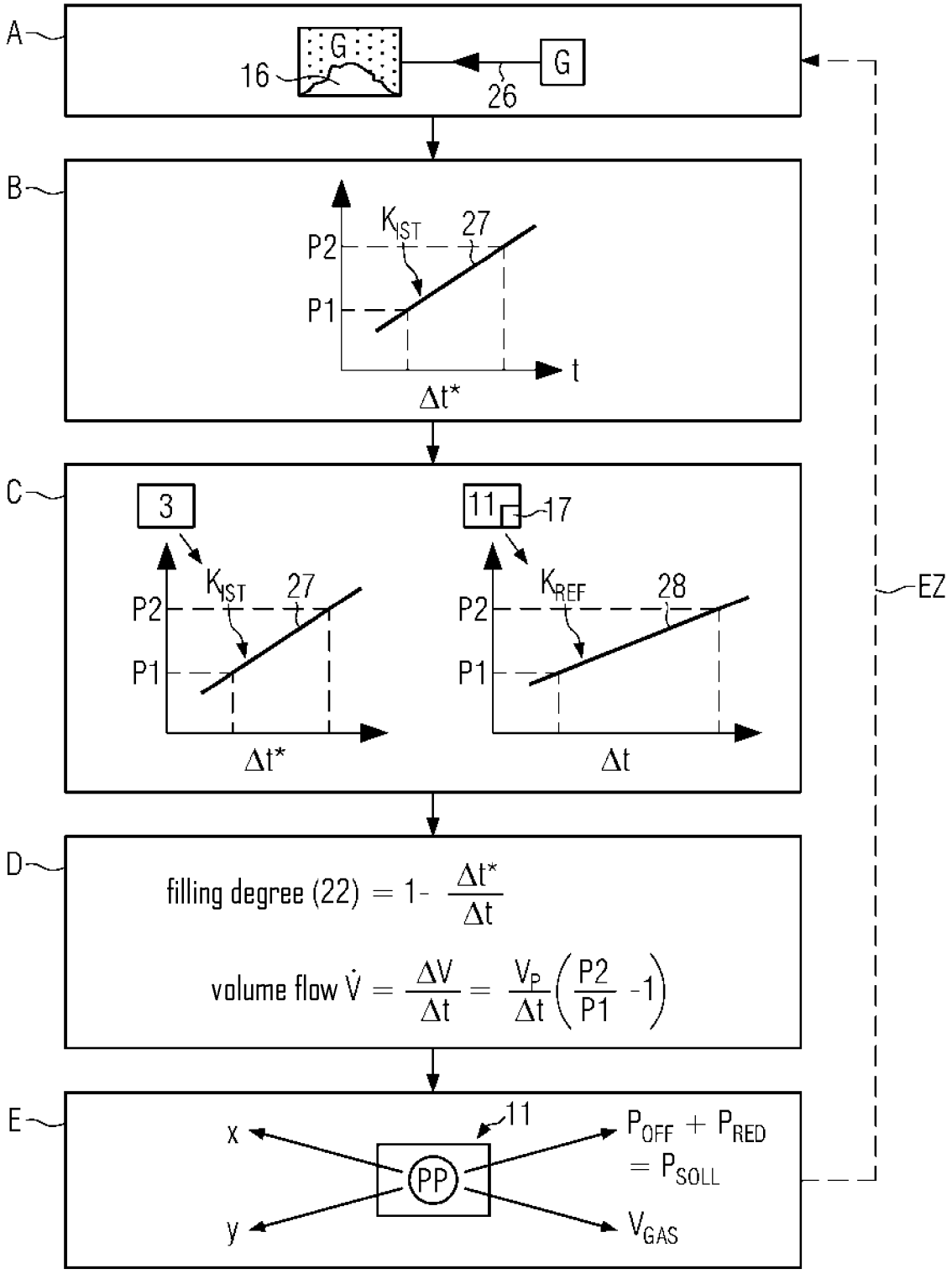
FIG. 4 is a schematic flow chart of one embodiment of a method in accordance with the present disclosure.

FIG. 4 shows in a schematic representation a method making use of the present invention.

To begin with, the free package volume P is filled with a gas G via the line 26 in a first method step A, so as to create a desired atmosphere.

During the filling process according to step A, the pressure is detected within the package volume P using the sensor system 12 according to method step B. This allows detection of a time-dependent pressure curve 27 for the pressure $P_{IST}$ prevailing within the package volume P between an initial pressure P1 and a predetermined gas flushing pressure P2. The control unit 11 may here be configured such that only a section of the pressure curve 27 will be taken into account for the continued process.

According to FIG. 4, the pressure curve 27 detected in method step B is a linear pressure curve $K_{IST}$.

According to the further method step C, a comparison VG between the detected pressure curve 27 and a reference pressure curve 28 is made. The control unit 11 retrieves the reference pressure curve 28 from the memory 17 for making the comparison VG. The control unit 11 may be configured for retrieving, with respect to at least one process parameter predetermined for the production process at the packaging machine 1, in particular at the sealing station 3, a suitable reference pressure curve 28 from a plurality of reference pressure curves 28 provided on the memory 17. According to the reference pressure curve 28, a time-dependent reference pressure curve $K_{REF}$ is presented, which would occur in particular if empty packages LV used for the production process were gas flushed. For carrying out a meaningful comparison as well as for expediently deriving the filling degree 22, it will be advantageous to assume equal volume flows for the respective pressure curves 27, 28.

After the execution of method step C, in other words, after having compared the respective gradients of the pressure curve 27 and of the reference pressure curve 28, the filling degree 22 and/or the volume flow $\dot{V}$ is/are calculated according to the subsequent method step D. This is based in particular on the respective time intervals t and t* that elapsed for the pressure curve 27 as well as for the reference pressure curve 28, taking as a basis the package volume P and the respective pressure levels P1, P2.

The calculated filling degree 22 and/or volume flow $\dot{V}$ can be used by the control unit 11 in a further method step E for calculating at least one process parameter PP. The control unit 11 calculates, for example, an offset pressure $P_{OFF}$, a gas velocity $V_{GAS}$, a valve setting value x and/or it triggers, on this basis, a malfunction indicator y.

Making use of the offset pressure $P_{OFF}$, the control unit 11 will be able to calculate, in the light of a desired gas flushing target pressure $P_{SOLL}$ of finished packages V, a pressure $P_{RED}$, the filling process A being controlled until this pressure $P_{RED}$ is reached. This is schematically shown in FIG. 4 by the broken line EZ.

The principle according to the present invention is excellently suitable for use with a process-controlled packaging machine, in which respective working processes take place on a measurement-signal basis, so that, all things considered, both optimum process times as well as products of improved quality can be provided.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention.

As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A method of operating a sealing station of a packaging machine for producing, in case of varying filling degrees, packages with at least substantially similar package appearances, the method comprising:

filling a free package volume with a gas from an initial pressure prevailing in the package volume up to a predetermined gas flushing pressure for creating a desired atmosphere, the free packaging volume enclosed between a lower and an upper packaging material and defined by at least one package positioned within the sealing station;

detecting a pressure curve using at least one pressure-detecting sensor system connected to the package volume at least temporarily during the filling of the package volume, the pressure curve being detected based on a time-dependent pressure curve between the initial pressure and the predetermined gas flushing pressure;

comparing the detected pressure curve with a reference pressure curve, the reference pressure curve being detected based on a time-dependent pressure curve for filling a known free reference package volume of at least one reference package positioned within the sealing station with the gas between the initial pressure and the predetermined gas flushing pressure;

calculating at least one of a filling degree of the at least one package positioned within the sealing station and a volume flow for the package volume based on the comparison between the detected pressure curve and the reference pressure curve; and setting at least one process parameter of the packaging machine with regard to the calculated filling degree and/or the volume flow.

2. The method according to claim 1, wherein a quotient resulting from a ratio of a time detected for the pressure curve and a time detected for the reference pressure curve is subtracted from a whole for calculating the filling degree.

3. The method according to claim 1, wherein the calculating is carried out in real time per machine cycle, and the method further comprises executing an automated adaptation of the at least one process parameter based on the real-time calculation of the filling degree and/or the volume flow.

4. The method according to claim 1, wherein the at least one process parameter is an offset pressure used during one of the filling process or at least one subsequent filling process, to fill the package volume with gas until a reduced pressure is reached, wherein the reduced pressure results from a gas flushing target pressure for finished packages minus a calculated offset pressure.

5. The method according to claim 4, further comprising determining a calculated offset pressure using the Boyle-Mariotte law, taking into account a partial volume of the package volume displaced by a sealing stroke and the free package volume, which can be determined in view of the calculated filling degree, including the gas flushing target pressure of finished packages to be generated in the free package volume.

6. The method according to claim 1, wherein the at least one process parameter comprises a gas velocity reached at respective gas pins configured for filling the package volume.

7. The method according to claim 1, wherein the at least one process parameter comprises a valve setting value which influences an evacuating process and/or the gas flushing process.

8. The method according to claim 1, wherein the at least one process parameter triggers a malfunction indicator at the packaging machine.

9. The method according to claim 1, wherein the free package volume is operably connected to a collecting volume of known size and the free package volume is calculated using a detected pressure compensation.

10. The method according claim 1, wherein the at least one process parameter is continuously adjusted based upon averaged values of at least one of the filling degree and the volume flow.

11. The method according to claim 1, wherein the filling of the free package volume is performed such that a pressure compensation between a plurality of packages positioned within the sealing station occurs during a sealing stroke.

12. The method according to claim 1, wherein calculating the filling degree includes subtracting a supply line volume connected to the package volume.

13. A packaging machine for producing, in case of varying filling degrees, packages with at least substantially similar package appearances, the packaging machine comprising:

a sealing station and a control unit, the control unit being functionally connected to a sensor system provided at the sealing station and operable to detect a pressure of a package volume provided within the sealing station;

wherein the control unit is operable to calculate at least one of a filling degree associated with the package volume and a volume flow associated with the package volume based on a comparison between a time-dependent pressure curve and a time-dependent reference pressure curve, wherein the time-dependent pressure curve is detectable between predetermined pressure levels at least temporarily during a filling process of the package volume enclosed within the sealing station and the time-dependent reference pressure curve is representative of a filling process of a known reference volume and stored in the control unit between the predetermined pressure levels; and wherein the control unit is operable to set at least one process parameter of the packaging machine based upon at least one of the calculated filling degree and the volume flow.

14. A method of operating a sealing station of a packaging machine for producing, in case of varying filling degrees, packages with at least substantially similar package appearances, the method comprising:

filling a free package volume enclosed between a lower and an upper packaging material and defined by at least one package positioned within the sealing station with a gas, the gas intended to be used for creating a desired atmosphere, and the free package volume is filled from an initial pressure prevailing in the package volume up to a predetermined gas flushing pressure;

detecting, at least temporarily during filling of the package volume, a pressure curve using at least one pressure-detecting sensor system connected to the package volume, the pressure curve being detected based on a time-dependent pressure curve between the initial pressure and the predetermined gas flushing pressure;

comparing the detected pressure curve with a reference pressure curve detected based on a pressure curve, which is time-dependent, for filling a known free reference package volume of at least one reference package positioned within the sealing station with the gas between the initial pressure and the predetermined gas flushing pressure; and setting at least one process parameter of the packaging machine based upon the comparison of the detected pressure curve with the reference pressure curve.

15. The method according to claim 14, wherein the at least one process parameter comprises an offset pressure used during the filling process and/or during at least one subsequent filling process, so as to fill the package volume with gas until a reduced pressure is reached, wherein the reduced pressure results from a gas flushing target pressure for finished packages minus a calculated offset pressure.

16. The method according to claim 14, wherein the at least one process parameter comprises a gas velocity reached at respective gas pins configured for filling the package volume.

17. The method according to claim 14, wherein the at least one process parameter comprises a valve setting value which influences an evacuating process and/or the gas flushing process.

18. The method according to claim 14, wherein the at least one process parameter triggers a malfunction indicator at the packaging machine.

19. A packaging machine for producing, in the case of varying filling degrees, packages with at least substantially similar package appearances, the packaging machine comprising:

a sealing station and a control unit, the control unit being functionally connected to a sensor system that is provided at the sealing station and operable to detect a pressure of a package volume provided within the sealing station, wherein the control unit is operable to run a comparison between a time-dependent pressure curve and a time-dependent reference pressure curve;

wherein the time-dependent pressure curve is detectable between predetermined pressure levels at least temporarily during a filling process of the package volume enclosed within the sealing station, and the time-dependent reference pressure curve is representative of a filling process of a known reference volume and stored in the control unit between the predetermined pressure levels; and the control unit is operable to set at least one process parameter of the packaging machine based upon the comparison between the time-dependent pressure curve and the time-dependent reference pressure curve.

* * * * *